United States Patent [19]

Becker, Jr.

[11] 4,166,007

[45] Aug. 28, 1979

[54] APPARATUS FOR CATCHING COKE OVEN SPILLAGE

[75] Inventor: Joseph Becker, Jr., Pittsburgh, Pa.

[73] Assignee: Koppers Company, Inc., Pittsburgh, Pa.

[21] Appl. No.: 917,495

[22] Filed: Jun. 21, 1978

[51] Int. Cl.[2] ..... C10B 29/00; C10B 35/00; B65G 25/00

[52] U.S. Cl. ..... 202/262; 202/270; 414/154

[58] Field of Search ..... 202/262, 270; 214/18 R, 214/23

[56] References Cited

U.S. PATENT DOCUMENTS 2,224,392 12/1940 Imes ..... 214/23

FOREIGN PATENT DOCUMENTS 4534931 5/1967 Japan ..... 202/262

*Primary Examiner*—R. E. Serwin
*Assistant Examiner*—Chris Konkol
*Attorney, Agent, or Firm*—Herbert J. Zeh, Jr.; Oscar B. Brumback

[57] ABSTRACT

An apparatus for catching coke oven spillage, generally comprised of a hopper movable along the bench floor located on the pusher side of a coke oven battery. The apparatus is positionable along the bench floor adjacent to any one of the ovens which comprise a coke oven battery such that coke released from the oven on the pusher side during the removal of the coke oven door and return stroke of a pusher ram is captured in the hopper. The apparatus is capable of depositing captured coke back into the particular coke oven.

5 Claims, 5 Drawing Figures

APPARATUS FOR CATCHING COKE OVEN SPILLAGE

BACKGROUND OF THE INVENTION

The present invention relates to the process of making coke; more specifically, to the prevention of coke buildup on the bench floor located on the pusher side of a coke oven battery as a result of coke oven spillage.

To process coal into coke, it is necessary to bake coal in the absence of air. To make industrial quantities of coke, a series of coke ovens are used, linearly aligned to form a coke oven battery. Coal is deposited in an oven through a plurality of holes in the roof of each oven. The oven is then sealed off and heat is applied. Each oven of a battery has a door on each side of the oven. After the coal is sufficiently heated or coked, the doors are removed from each side of a coke oven and a ram from a pusher machine is projected into one side of the oven, commonly referred to as pusher side, causing the process coal or coke to be ejected from the other side of the oven. The coke is then collected and transported to a quenching facility.

When the oven door on the oven pusher side is removed, a portion of the oven contained coke spills therefrom onto a bench floor which is adjacent to and extends the length of the coke oven battery. In addition, during the return stroke of the pusher ram, residual coke in the oven collects on the back face of the ram. As the ram journeys out of the oven, the residual coke is deposited along the bench floor. Coke removed from a coke oven during the return stroke of the ram is commonly referred to as coke oven pullback.

The coke which is deposited on the bench floor during the return stroke of the pusher ram creates a dust-ladden environment in the proximate area. Conventional means of collecting this coke has employed manual labor, thereby exposing the laborer to extremely high concentrations of dust posing a health hazard to the laborer. In addition, the coke which is deposited on the bench floor is of a relatively high temperature, posing an additional threat of serious bodily injury to laborers assigned to maintain the bench floor. The coking process generates by-product toxic gases, some of which may linger in the bench area posing a further health hazard to the laborer.

This invention eliminates the necessity of having a laborer maintain the bench floor on the pusher side of a coke oven battery.

SUMMARY OF THE INVENTION

An apparatus for catching coke oven spillage, generally comprised of a hopper mounted to a support structure movable along a bench floor adjacent to a coke oven battery. The hopper can be automatically positioned adjacent to an oven of the coke oven battery such that coke released from the oven on the pusher side during the removal of the coke oven door and return stroke of a pusher ram is captured in the hopper. The hopper can be automatically activated to deposit the captured coke back into the oven.

DETAILED DESCRIPTION OF THE PREFERRED EMBODIMENT

Figure 1:
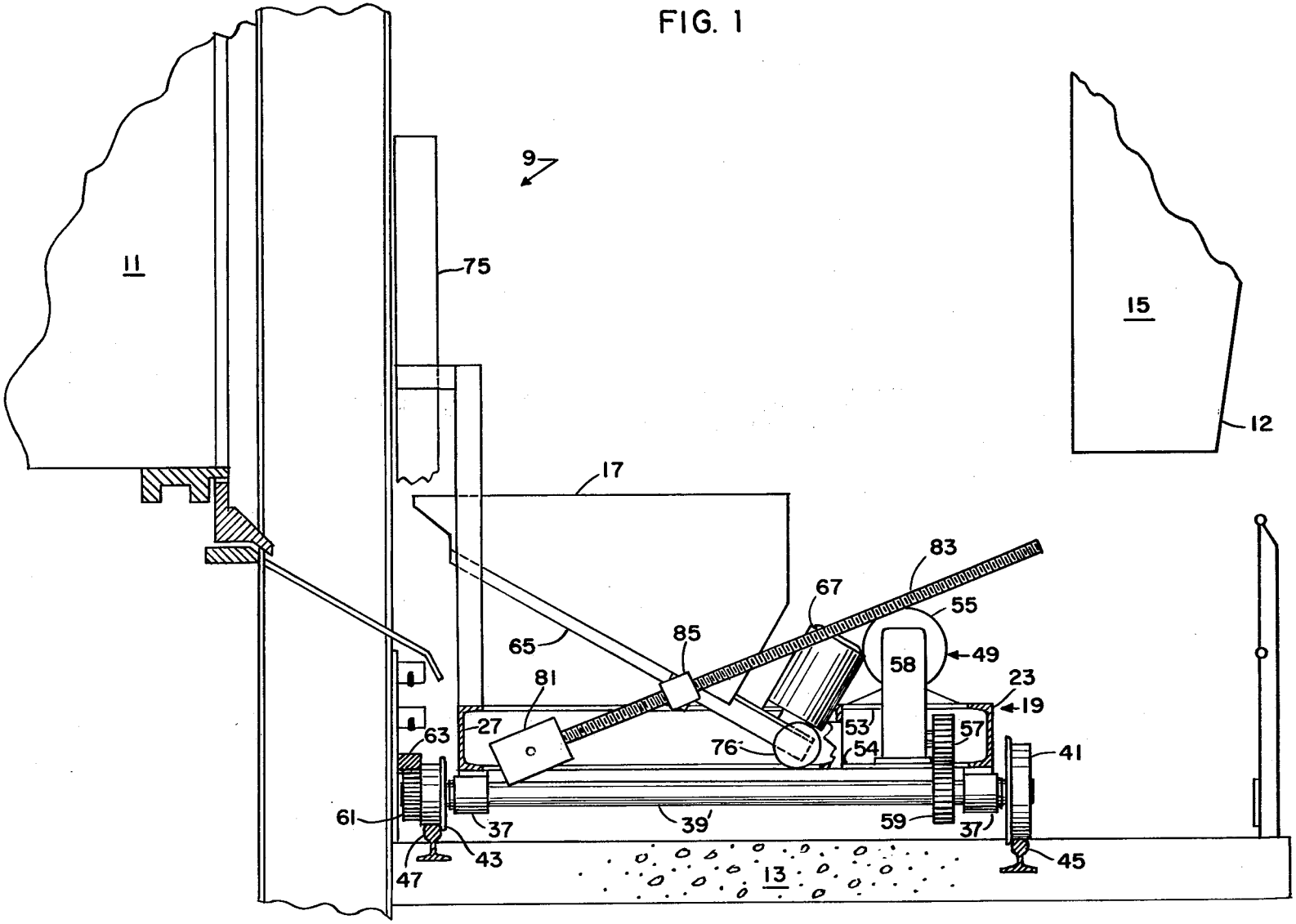
FIG. 1 is a side sectional view of an apparatus for catching coke oven pullback in the travel position.

Generally shown in FIG. 1 is the pusher side of coke oven battery 9, i.e., the side from which a pusher ram 15 enters a coke oven 11 by conventional means to eject the coke from the oven 11. Only a portion of pusher ram 15 is shown in FIG. 1.

When the oven door on the pusher side (not shown) is removed, oven contained coke spills therefrom. Also, as the pusher ram 15 withdraws from a coke oven, residual coke in the oven which has collected on the back face 12 of the pusher ram 15 spills therefrom, commonly referred to as coke oven pullback. In accordance with the present invention, a hopper 17 is mounted to a support carriage 19 which rests on a bench 13 extending horizontally along and is adjacent to the battery 9. Carriage 19 includes four channel beam support members 21, 23, 25 and 27 (refer to FIG. 2). Support member 21 of carriage 19 has one end fixably mounted by any conventional means, such as welding, to one end of support member 23 and a corner mount 29, and the other end mounted by conventional means to one end of support member 27 and a corner mount 31. Support member 25 has one end mounted by any conventional means to the other end of support member 23 and corner mount 33, and the other end is mounted by any conventional means to the other end of support member 27 and corner mount 35.

Figure 2:
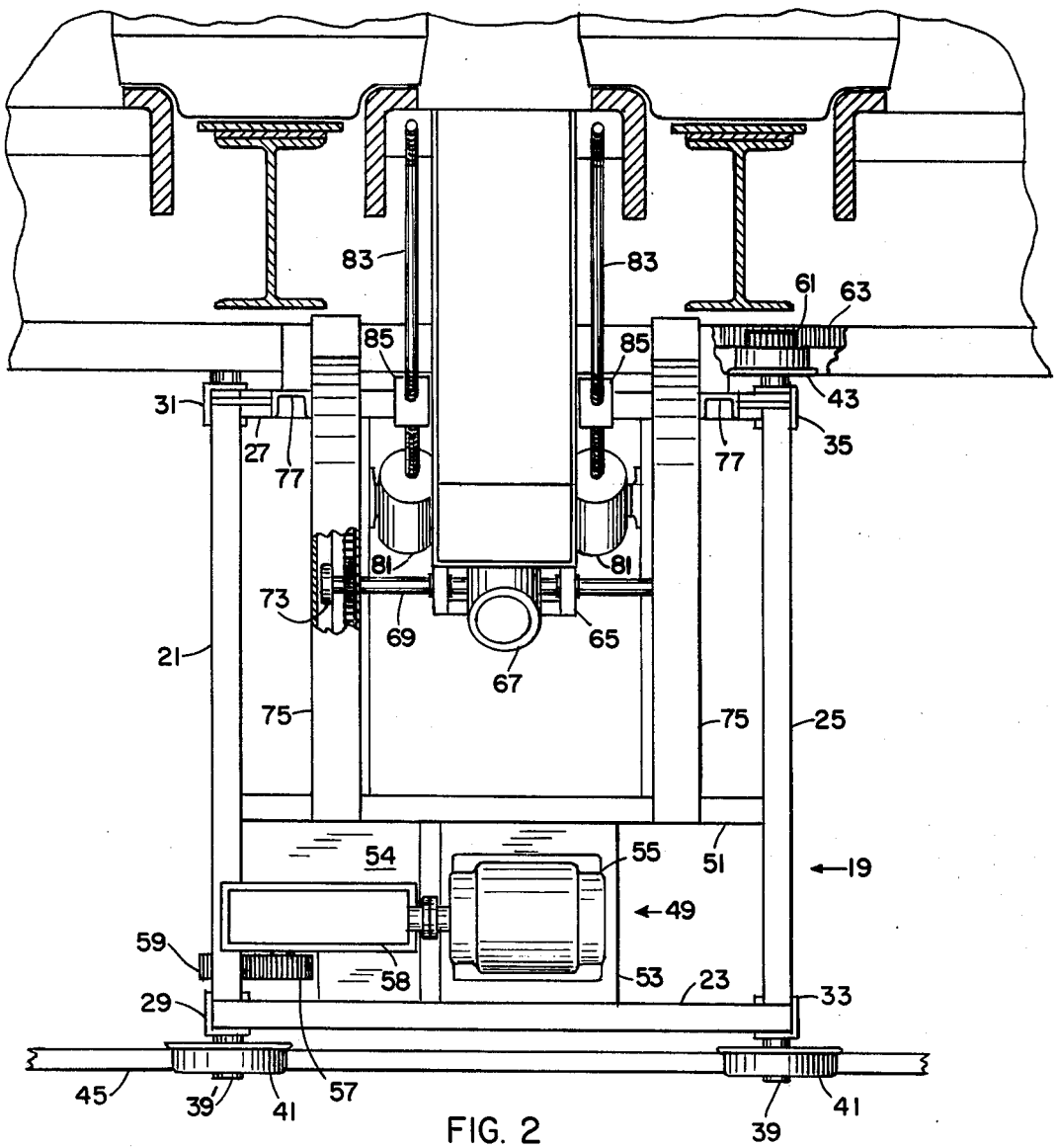
FIG. 2 is a plan view of the apparatus in catch position.

Fixably mounted to the underside of each corner mount 29, 31, 33 and 35 is a bearing mount 37 (FIGS. 1 and 2). The bearing mounts 37 rotatably secure axles 39 and 39'. Fixably secured by any conventional means at alternate ends of each axle 39 and 39' is a wheel 41 and a wheel 43. Wheels 41 and 43 ride on rails 45 and 47, respectively; rails 45 and 47 being mounted to bench floor 13 by conventional means.

A drive system 49 on carriage 19 motivates carriage 19 along bench 13. To accommodate the drive system 49, the carriage 19 has a support bar 51 extending from support member 21 to support member 25 and, thereto, fixably mounted by any conventional means, such as welding. A support plate 53 is mounted by conventional means between support member 23 and support bar 51. Fixably mounted to the support plate 53 is a drive motor 55 which is fixably coupled to a conventional gear box 58, which is also fixably mounted to plate 54 fixably mounted to and extending between support members 23 and support bar 51. Gear box 58 has a side gear 57 which coacts with gear 59. Gear 59 is fixably mounted around the forward axle 39', as viewed in FIG. 2, such that activation of the drive motor 55 directly translates to gear box 58 which drives gear 57, causing gear 59 to rotate axle 39', thereby propelling the carriage 19 along bench floor 13. To assist in proper positioning of the carriage 19 along bench floor 13 is a pinion 61, fixably mounted to the end of wheels 43. Gear 61 coacts with a rack 63 which is mounted to and extends along the coke oven battery 9.

Figure 3:
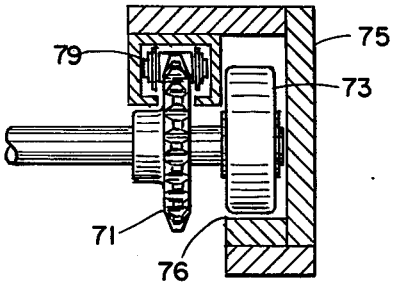
FIG. 3 is a cross-sectional view of the lift track.
Figure 4:
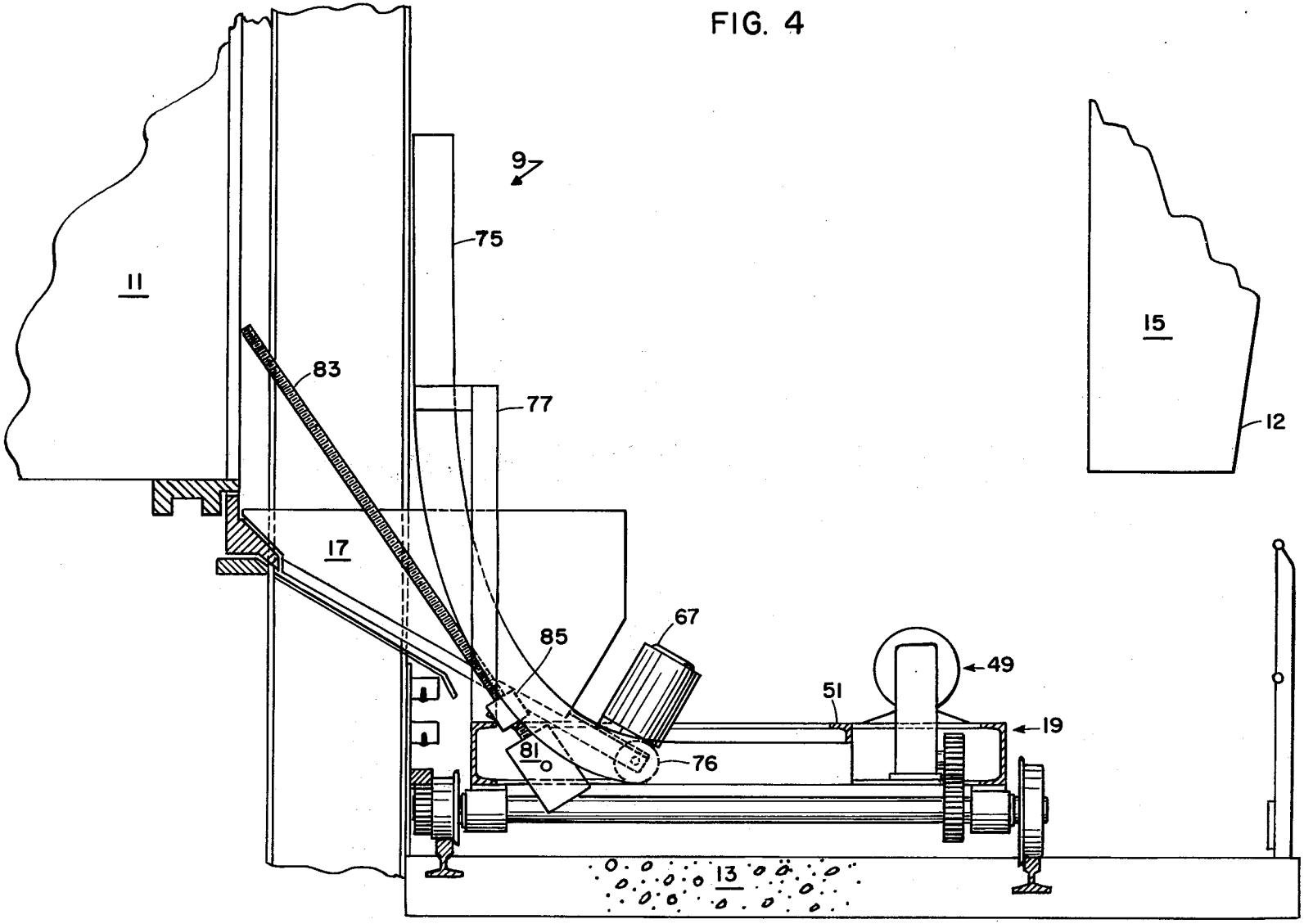
FIG. 4 is a side sectional view of the apparatus in the catch position.

Hopper 17 has a hopper understructure 65 which has mounted thereto a drive means 67. Rotatably mounted to the hopper understructure 65 is axle 69. The drive means 67 is coupled to axle 69 by any conventional means (not shown) such that axle 69 is rotatably activated by drive means 67. Fixably mounted by conventional means to each end of axle 69 is a sprocket 71 and a guide wheel 73 (refer to FIGS. 2 and 3). A plurality of lift tracks 75 support guide wheel 73. Lift tracks 75 are fixably mounted by any conventional means to support bar 51 and a guide track support member 77 which is fixably mounted to the lateral extremes of member 27 (refer to FIG. 4). Referring more specifically to FIG. 3, guide wheel 73 rests on a lift track surface 76. Fixably mounted by conventional means, mounted to each track 75 is a chain 79 which coacts with sprocket 71. The guide track 75 extends horizontally from support bar 51 and gradually arches to a vertical extension, thereby providing a means to vertically lift and horizontally displace hopper 21 upon activation of drive means 67.

Assisting to stabilize the hopper as it is lifted and horizontally projected into the coke oven, screw drive motors 81 which have a threaded shaft 83 are rotatably mounted to the side of each lift track 75. The shaft 83 coacts with member 85 which is rotatably mounted to the side of the understructure 65 of hopper 17.

Figure 5:
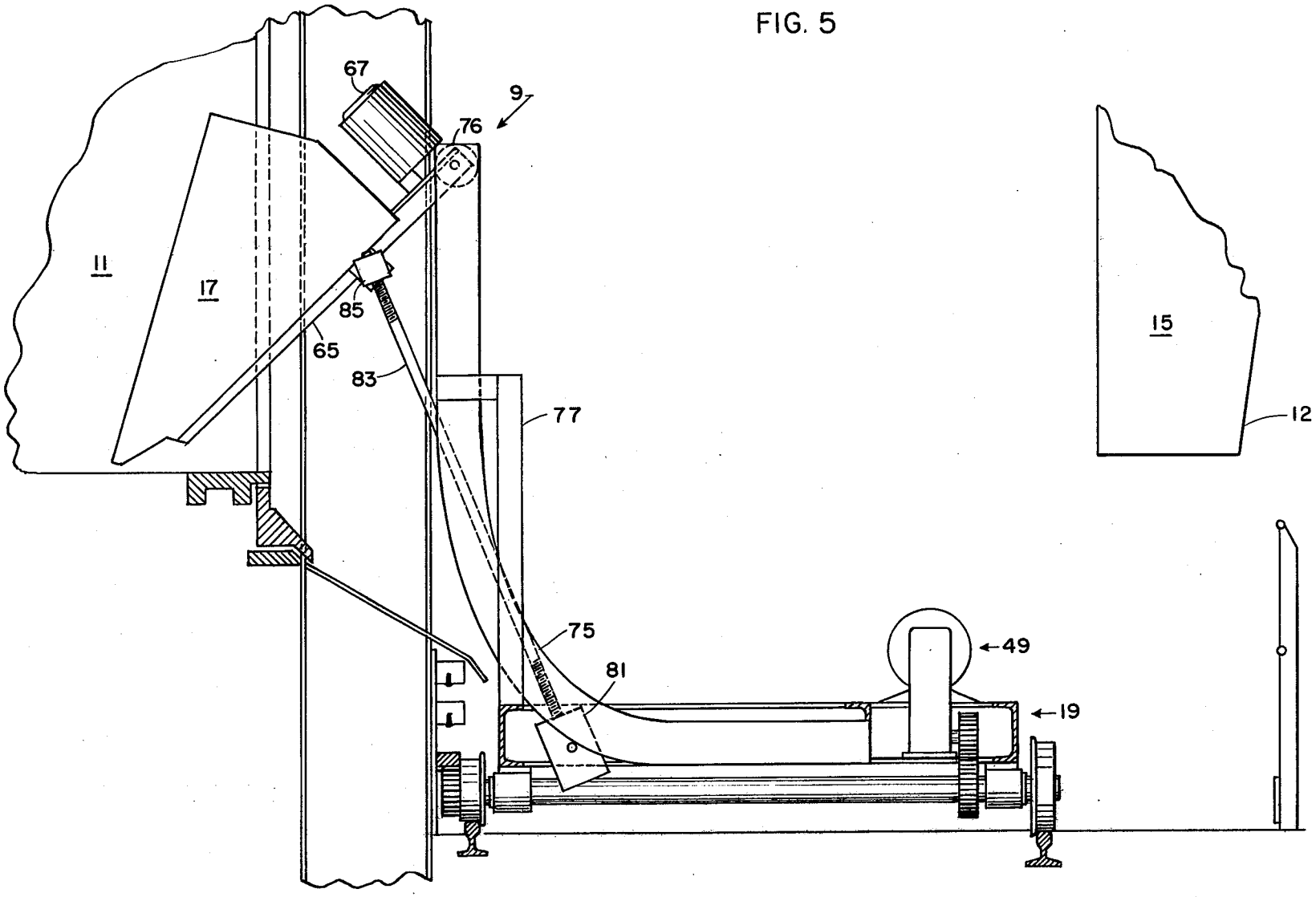
FIG. 5 is a side sectional view of the apparatus in a dump position.

In operation, the drive means 55 motivates carriage 19 to assume a position on the bench floor 13 such that hopper 17 is directly across from an oven 11 (refer to FIG. 1). Prior to the removal of the coke oven door on the pusher side (not shown), drive means 67 is activated by any conventional remote means to horizontally project hopper 17 direcly adjacent to and below the oven 11, such that when the oven door on the pusher side is removed and pusher ram 15 withdraws from an oven 11, coke which spills during door removal and which collects on the back face 12 of ram 15 falls into hopper 17 (refer to FIG. 4). The hopper drive means 67 is then reactivated to cause hopper 17 to experience further horizontal plus simultaneous vertical projection, such that the hopper 17 is projected into an oven 11 (refer to FIG. 5). Upon the initial activation of drive means 67, screw drive 81 is activated by any conventional remote means such that shaft 83 does not inhibit the horizontal motion of hopper 17. When drive means 67 is reactivated, screw drive 81 is simultaneously reactivated to maintain hopper 17 in a horizontal trajectory until hopper 17 has entered the oven 11, thereupon causing hopper 17 to tilt downward, depositing the hopper-contained coke back into the coke oven. The drive means 67 and screw drive motors 83 are then activated in a reverse mode, causing hopper 17 to be repositioned on carriage 19. Drive system 49 is then activated by any conventional remote means to reposition hopper 17 adjacent to another oven 11 of battery 9 in the aforedescribed manner.

It is noted that conventionally there is a control cab on the pusher ram machine (not shown). One reasonably skilled in the art can adapt a control system strategically located to control the operation of the herein disclosed invention.

I claim:

1. An apparatus, for catching and collecting discharged coke from a coke oven as a consequence of oven door removal on the pusher side and coke oven pullback, located on the pusher side of a coke oven battery, comprising:

(a) a platform extending the length of said coke oven battery;

(b) a hopper adapted to fit within said coke oven;

(c) support means for supporting said hopper, said support means being movable along said platform;

(d) elevating means for elevating and horizontally projecting said hopper aloft from said support means and into said coke oven, said elevating means being able to move said hopper horizontally on said support means such that said hopper is adjacent to and below said coke oven to receive any of said coke removed from said oven as a result of coke oven pullback prior to the introduction of said hopper into said oven;

(e) means for tilting said hopper when said hopper is in an elevated position and within said oven; and (f) positioning means for positioning and repositioning said hopper, and support means along said platform adjacent to any of a predetermined one of said coke oven of said coke oven battery.

2. An apparatus as claimed in claim 1, wherein said elevating means comprises:

(a) a plurality of lift tracks fixably mounted to said support means such that said hopper is there-in between, said tracks having a guide wheel surface, said lift track extending horizontally across said support means towards said oven and gradually arching to a vertical extension;

(b) chain fixably mounted to at least one of said tracks horizontally displaced from said guide wheel surface and extending the length of said track;

(c) an axle member rotatably mounted to said hopper;

(d) drive means to rotate said axle;

(e) a plurality of guide wheels rigidly mounted to said axle member and resting on each of said guide wheel surfaces; and (f) a sprocket fixably mounted to said axle member and cooperatively engaging said chain;

whereby rotation of said axle rotates said sprocket which coacts with said chain to propel said hopper along said lift track.

3. An apparatus as claimed in claim 1, wherein said tilt means comprises:

(a) a plurality of screw drive motors rotatably mounted to the side of each of said lift tracks, each of said screw drive motors having elongated shaft; and (b) a member rotatably mounted to said hopper such that said member can rotate parallel to said hopper, said member coactively engaging said elongated shaft such that rotation of said shaft will displace said member along said shaft;

whereby rotation of said shaft coacts with said member to effect the trajectory of said hopper.

4. An apparatus as claimed in claim 1, wherein said positioning means comprises:

(a) a plurality of axles rotatably mounted to said support means;

(b) a plurality of wheels fixably mounted to said axle;

(c) a plurality of rails fixably mounted to said platform, said wheels aligned to ride along said rails; and (d) second drive means for rotating at least one of said axles.

5. An apparatus, for catching coke discharged from a coke oven due to oven door removal on the pusher side and coke oven pullback, located on a bench floor of a battery of coke ovens on the pusher side, which comprises:

(a) a hopper adapted to enter into a coke oven;

(b) means for supporting said hopper;

(c) a plurality of lift tracks fixably mounted to said support means, at least one of said tracks positioned to either side of said hopper, said lift tracks extending horizontally across said support means towards said oven, gradually arching to a vertical extension, said tracks having a guide wheel surface;

(d) a chain fixably mounted to the upper surface of said track horizontally removed from the guide wheel surface extending the length of the upper surface;

(e) an axle member rotatably mounted to said hopper;

(f) drive means to rotate said axle;

(g) a guide wheel rigidly mounted to said axle member resting on said guide wheel surface;

(h) a sprocket fixably mounted to said axle member and cooperatively engaging said chain, whereby activation of said drive means rotates said axle, thereby rotating said sprocket which coacts with said chain to propel said hopper along said lift track;

(i) a plurality of screw drive motors, at least one rotatably mounted on the side of each of said lift tracks, said screw drive motors having an elongated shaft which is threaded;

(j) a plurality of members, at least one rotatably mounted to each side of said hopper, each of said members having a toothed hole therein adapted to cooperatively engage said shaft, whereby activation of said screw drive motors rotate said shaft within said member to effect the trajectory of said hopper;

(k) a plurality of axles rotatably annd supportably mounted to said support means;

(l) a plurality of wheels fixably mounted to said axle;

(m) a plurality of rails fixably mounted to said platform, said wheels aligned to ride along said rail; and (n) drive means for rotating at least one of said axles.

* * * * *